United States Patent [19]

McMahan

[11] Patent Number: 4,915,171

[45] Date of Patent: Apr. 10, 1990

[54] ABOVE PACKER PERFORATE TEST AND SAMPLE TOOL AND METHOD OF USE

[75] Inventor: Michael E. McMahan, Duncan, Okla.

[73] Assignee: Halliburton Company, Duncan, Okla.

[21] Appl. No.: 276,492

[22] Filed: Nov. 23, 1988

[51] Int. Cl.[4] ..... E21B 34/10; E21B 43/117; E21B 49/08

[52] U.S. Cl. ..... 166/264; 166/184; 166/240; 166/297

[58] Field of Search ..... 175/4.54, 4.52, 4.56; 166/264, 240, 129–131, 149–152, 183, 184, 297

[56] References Cited

U.S. PATENT DOCUMENTS

| | | | |
|---|---|---|---|
| 2,169,559 | 8/1939 | Halliburton | 166/1 |
| 2,681,110 | 6/1954 | Harrison | 166/55 |
| 2,740,479 | 4/1956 | Schwegman | 166/145 |
| 2,947,361 | 8/1960 | Hyde | 166/100 |
| 2,982,130 | 5/1961 | McMahan | 73/155 |
| 3,103,811 | 9/1963 | Ayres et al. | 73/152 |
| 3,189,094 | 6/1965 | Hyde | 166/55.1 |
| 3,253,654 | 5/1966 | Briggs, Jr. et al. | 166/100 |
| 3,254,531 | 6/1966 | Briggs, Jr. | 73/155 |
| 3,273,647 | 9/1966 | Briggs, Jr. et al. | 166/100 |
| 3,273,659 | 9/1966 | Reynolds, Jr. | 175/4 |
| 3,378,079 | 4/1968 | Page, Jr. | 166/129 |
| 3,456,726 | 7/1969 | Barrington et al. | 166/162 |
| 3,610,335 | 10/1971 | Smith | 166/55.1 |
| 3,664,415 | 5/1972 | Wray et al. | 166/0.5 |
| 3,703,104 | 11/1972 | Tampler | 166/240 X |
| 3,964,305 | 6/1976 | Wray et al. | 73/151 |
| 3,969,937 | 7/1976 | Barrington et al. | 73/151 |
| 3,986,554 | 10/1976 | Nutter | 166/240 X |
| 4,063,593 | 12/1977 | Jessup | 166/317 |
| 4,426,882 | 1/1984 | Skinner | 73/155 |
| 4,484,632 | 11/1984 | Vann | 166/297 |
| 4,564,076 | 1/1986 | Vann et al. | 166/55.1 X |
| 4,614,156 | 9/1986 | Colle, Jr. et al. | 102/312 |
| 4,633,952 | 1/1987 | Ringgenberg | 166/336 |
| 4,655,298 | 4/1987 | George et al. | 175/4.52 |
| 4,657,082 | 4/1987 | Ringgenberg | 166/336 |
| 4,749,037 | 6/1988 | Christensen | 166/131 X |
| 4,804,044 | 2/1989 | Wesson | 166/297 |

OTHER PUBLICATIONS

U.S. patent application Ser. No. 064,285 to Christensen, filed 6–19–87, continuation of which was filed 9–12–88, as Ser. No. 07/244,627, and a second continuation of which was filed 2–15–89, as Ser. No. 07/312,323, a notice of allowance has been received for the most recent continuation, (U.S. Pat. No. 4,878,538 to issue 11/7/89).

Halliburton Services Sales & Service Catalog No. 43, pp. 2548 and 2533–2534, published in 1985.

Engineered Weld Complation Products Catalog of Vann Systems, pp. B–5 through B–8 was published at least as early as Jan. 1, 1988.

GEO Vann Engineered Weld Completions Catalog, p. B–22, published in Nov., 1981.

*Primary Examiner*—Stephen J. Novosad

*Attorney, Agent, or Firm*—James R. Duzan; Neal R. Kennedy

[57] ABSTRACT

An above packer perforate, test and sample tool. The tool includes a tester valve which is positioned above a well packer and which has a bypass which provides communication between a well annulus above the packer and a firing mechanism for guns positioned below the packer. When the well annulus pressure is raised, the firing mechanism is triggered. The bypass may be closed prior to firing of the guns, and after perforation, a valve in the tester valve may be opened to flow a sample of well fluid into a sampling chamber located above the tester valve. A method of testing a well formation utilizing the apparatus is also disclosed.

20 Claims, 5 Drawing Sheets

ABOVE PACKER PERFORATE TEST AND SAMPLE TOOL AND METHOD OF USE

BACKGROUND OF THE INVENTION

1. Field Of The Invention

This invention relates to a tool for sampling fluids from downhole well formations, and more particularly, to a perforate, test and sample tool with a tester valve positioned above a packer and having a bypass means for allowing actuation by annulus pressure of a firing mechanism for guns below the packer.

2. Description Of The Prior Art

Well testing operations are commonly conducted on oil and gas wells in order to determine production potential and to enhance the same if possible. In flow testing a well, a tester valve is lowered into the well on a string of drill pipe above the packer. After the packer is set, the tester valve is opened and closed periodically to determine formation flow, pressure and rapidity of pressure recovery. One such downhole tool which is capable of performing in different modes of operation as a drill pipe tester valve, a circulation valve and a formation tester valve, as well as providing the operator with the ability to displace fluids in the pipe string above the tool with nitrogen or other gas prior to testing or retesting, is disclosed in U.S. Pat. No. 4,633,952 to Ringgenberg, assigned to the assignee of the present invention. This tool is also described in Halliburton Services Sales & Service Catalog No. 43, page 2548 as the Omni® circulating valve. Another similar circulating valve is disclosed in U. S. Pat. No. 4,657,082 to Ringgenberg, also assigned to the assignee of the present invention. As indicated, the Omni® circulating valve can be used as a tester valve, but is not adapted for use with pressure actuated time delay firing means for guns below a packer because the valve does not have a bypass which provides communication between the well annulus above the packer and the components of the tool string below the packer.

Preferably, formation testing is carried out by running a tool string into the well bore one time, making the test, and removing the tool string. Tester valves positioned below packers have been utilized to perform such tests, but these devices are relatively complex. Accordingly, there is a need for a simplified testing system. The present invention provides a perforate, test and sample (PTS) tool which can be lowered into a well bore on a tool string including a packer so that the well bore may be closed off prior to actuating perforating guns positioned below the packer. Well annulus pressure must be used to actuate the firing mechanism for the guns, and the present invention includes a tester valve disposed above the packer which has a bypass means for providing fluid communication from the well annulus above the packer to the firing mechanism below the packer. The bypass means is closeable prior to the actual firing due to a time delay in the firing mechanism. The tester valve is basically an upside-down and modified version of the Omni® circulating valve, so that the bypass means is positioned below the sampling valve means in the tester valve. The tester valve of the present invention is used to fill a relatively small sampling chamber, and thus high flow rates are not necessary. The present invention therefore uses a sliding sleeve valve means rather than a relatively expensive ball valve means.

SUMMARY OF THE INVENTION

The above packer perforate, test and sample tool of the present invention includes a valve for use above a packer in a well testing string, a downhole tool utilizing such a tester valve and a method of testing a well formation in a well bore.

The tester valve comprises housing means for connecting to the tool string, the housing means defining a substantially longitudinally extending central opening therethrough, bypass means on the housing means for providing communication between the central opening and a well annulus portion above the packer, whereby annulus pressure may be communicated to a tool string portion below the packer, and valve means disposed above the bypass means in the housing means for providing communication between the central opening and a portion of the tool string, such as a sampling chamber, above the housing means. Both the bypass means and the valve means preferably are slidable and have selectable open and closed positions.

The tester valve further comprises actuating means for selectively opening and closing the bypass means and the valve means. In the preferred embodiment, the actuating means comprises a ratchet on the bypass means and an operating piston slidably disposed in the housing means which engages the ratchet for actuating the bypass valve in response to well annulus pressure. A biasing means is preferably provided for biasing the actuating means upwardly within the housing means when the well annulus pressure is relieved. In one embodiment, the biasing means comprises a gas filled chamber which exerts an upwardly acting pressure on the actuating means. The gas can be of any generally inert gas known in the art, such as nitrogen.

The bypass means comprises a housing port defined in the housing means which opens into the well annulus portion above the packer and a slidable bypass valve having a substantially transverse bypass port therein. The bypass valve port is substantially aligned with the housing port when the bypass means is in the open position.

The valve means may be characterized by a mandrel disposed in the housing means and defining a mandrel port therein which is in communication with the portion of the tool string above the housing means and a valve sleeve slidably disposed on the mandrel and defining a valve port therein. The valve port is substantially aligned with the mandrel port when the valve means is in the open position.

The tester valve further comprises means for releasably connecting the valve means to the bypass means. In one embodiment, this means for releasably connecting comprises collet means in which there are collet fingers extending from one of the valve means and bypass means which are engageable with a collet recess defined in the other of the valve means and bypass means. In the embodiment shown in the drawings, the collet fingers are on the valve means and the collet recess is on the bypass means, but it will be seen by those skilled in the art, that these could be reversed.

Stated in another way, the present invention includes a downhole tool for use in a well bore which comprises guns for perforating a well formation in the well bore, firing means for firing the guns, a packer disposed above the guns and firing means for isolating the formation from an upper well annulus portion above the packer, a sampling chamber disposed above the packer, and a tester valve disposed above the packer and in communication with a sampling chamber. The tester valve comprises bypass means for selectively providing communication of fluid pressure in the upper well annulus to the firing means after setting of the packer and valve means for selectively providing communication between the well formation and the sampling chamber so that the sampling chamber may be filled with a sample of fluid from the formation.

The method of testing a well formation of the present invention comprises the steps of positioning guns on a tool string in the well bore adjacent to the formation, and actuating a packer on the tool string for sealingly engaging the well bore above the formation such that an upper well annulus portion is defined between the well bore and the tool string above the packer, providing pressure in the upper well annulus portion, through a bypass and a tester tool above the packer, to a firing device adjacent to the guns for firing the guns and perforating the formation, and flowing a sample of fluid from the formation through the tester valve to a sampling chamber positioned above the packer. The step of providing pressure preferably comprises opening a bypass valve in the tester valve above the packer in response to a pressure in the upper well annulus portion. The method further comprises closing the bypass valve prior to the step of flowing a sample. Preferably, time delay firing means are used s that the bypass valve is closed prior to the actual firing of the guns. In the method, the step of flowing a sample preferably comprises opening a sampling valve in the tester valve in response to a pressure in the upper well annulus portion. The bypass and sampling valves may be selectively opened and closed as many times as desired.

An important object of the present invention is to provide a perforate, test and sample tool with a tester valve positioned above a packer which has bypass means for allowing actuation of a firing mechanism for guns below the packer after the packer is set.

Another object of the invention is to provide a tester valve with a bypass means below a sampling valve means therein.

A further object of the invention is to provide a simplified downhole tool for use in sampling a well formation.

An additional object of the invention is to provide a method of testing a well formation which uses a single trip into the well bore.

Additional objects and advantages of the invention will become apparent as the following detailed description of the preferred embodiment is read in conjunction with the drawings which illustrate such preferred embodiment.

DESCRIPTION OF THE PREFERRED EMBODIMENT

Figure 1A:
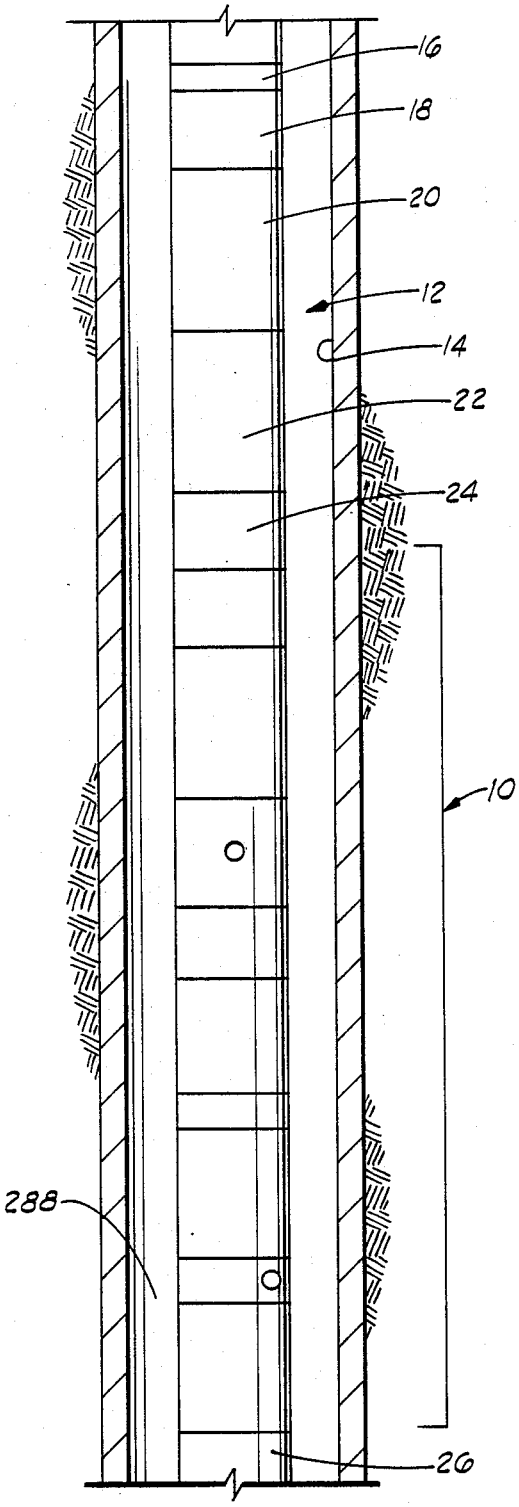
FIGS. 1A and 1B show a schematic of the perforate, test and sample tool of the present invention on a tool string positioned in a well bore.
Figure 1B:
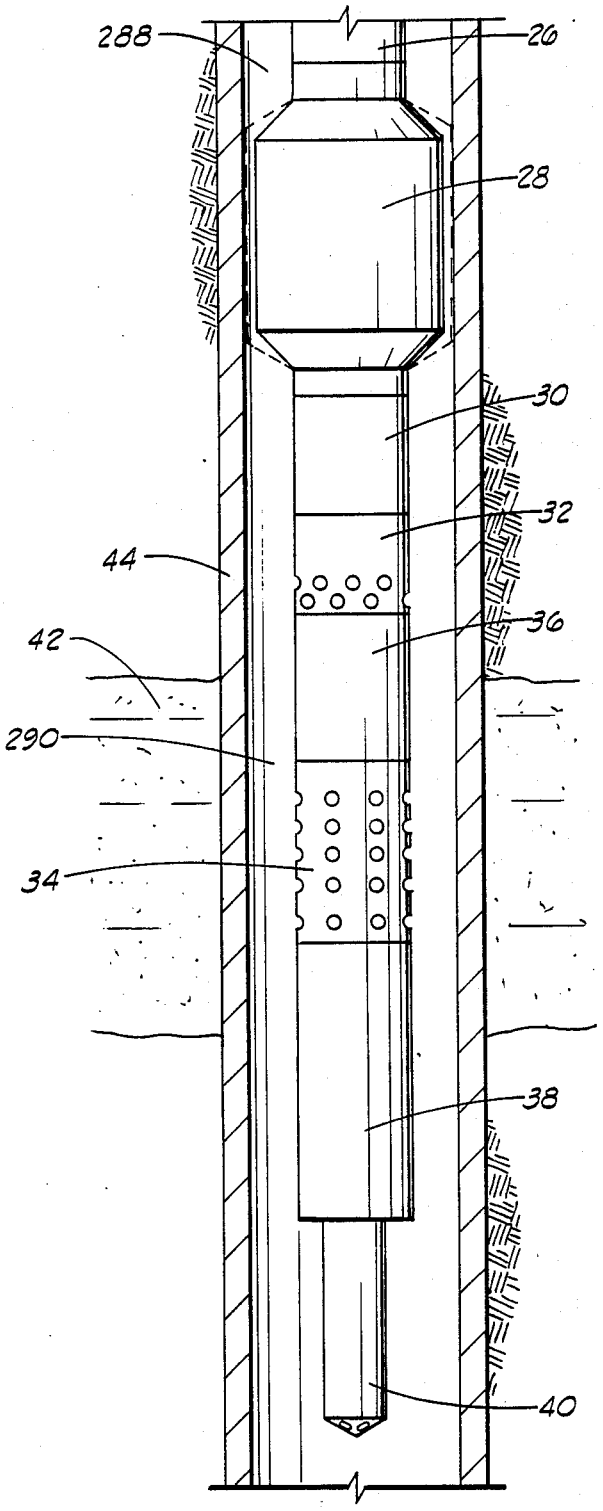

Referring now to the drawings and more particularly to FIGS. 1A and 1B, the tester valve of the perforate, test and sample tool of the present invention is shown and generally designated by the numeral 10. Tester valve 10 forms a part of a tool string 12 positioned in a well bore 14.

Typically, a bull plug 16, an upper drain sub 18, a sample chamber 20, a gauge carrier 22 and a lower drain sub 24 are positioned above tester valve 10. All of these components are of a kind generally known in the art.

Below tester valve 10 are a safety joint 26, hydraulic circulating valve; if desired, a casing packer 28, a tubing pup joint 30 and a flow check valve 32. Below check valve 32 are perforating guns 34 with a firing means 36 disposed thereabove. Firing means 36 is preferably a TDF (time-delayed firing) differential delay firer. Below perforating guns 34 are blank guns 38 and a gauge carrier 40. All of these components below tester valve 10 are also of a kind generally known in the art.

As will be discussed in more detail herein, tool string 12 is positioned such that perforating guns 34 are adjacent to a well formation 42 which is to be tested. Perforating guns 34 are adapted for perforating well casing 44 and formation 42 so that fluid may be flowed from the formation for testing and so a sample may be taken.

Figure 2A:
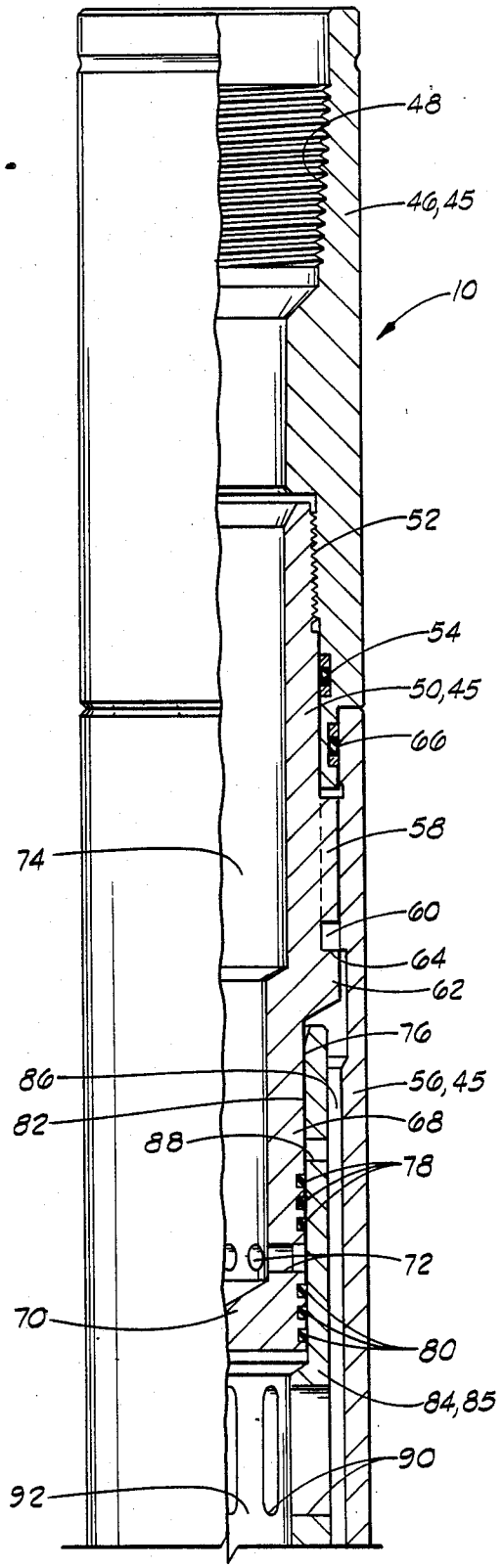
FIGS. 2A–2G show a partial longitudinal cross section of the tester valve of the tool.

Referring now to FIGS. 2A–2G, the details of tester valve 10 will be discussed. As seen in FIG. 2A, the outer portion of tester valve 10 comprises a housing means 45 including, at the upper end, a top coupling 46 having a threaded bore 48. Threaded bore 48 is adapted for connection to the upper portion of tool string 12. The lower end of top coupling 46 is connected to a ported mandrel 50 at threaded connection 52. Ported mandrel 50 is also a part of housing means 45. A sealing means 54 provides sealing engagement between top coupling 46 and ported mandrel 50.

An intermediate portion of ported mandrel 50 is connected to the upper end of another component of housing means 45, valve case 56. Relative rotation between ported mandrel 50 and valve case 56 is prevented by the interaction of lugs 58 on the ported mandrel with corresponding lugs 60 on the valve case. An annular flange 64 on ported mandrel 50 engages the lower end of lugs 64 of valve case 56, preventing relative longitudinal movement between the ported mandrel and valve case when top coupling 46 is connected to ported mandrel 50. A sealing means 66 provides sealing engagement between top coupling 46 and valve case 56.

The lower end of ported mandrel 50 comprises a substantially cylindrical portion 68 having a closed lower end 70. Cylindrical portion 68 of ported mandrel 50 defines a plurality of substantially transverse ports 72 therethrough adjacent to closed end 70. It will be seen that ports 72 are in communication with central cavity 74 in ported mandrel 50 which is also in communication with the upper portion of tool string 12, specifically sample chamber 20.

Cylindrical portion 68 of ported mandrel 50 has an outside diameter 76. A plurality of upper seals 78 are disposed in corresponding grooves in outside diameter 76 on one side of ports 72, and a plurality of lower seals 80 are disposed in corresponding grooves in outside diameter 76 on an opposite side of ports 72. Thus, a first and second sealing means is provided o opposite sides of ports 72.

Slidably engaged with outside diameter 76 on cylindrical portion 68 of ported mandrel 50 is a first bore 82 of a valve sleeve 84. Thus, a sliding valve means 85 is provided, of which valve sleeve 84 is a part. It will be seen that first bore 82 is sealingly engaged with seals 78 and 80. An annulus 86 is defined between valve sleeve 84 and the wall of valve case 56. A plurality of substantially transverse ports 88 are defined through valve sleeve 84. In the position shown in FIG. 2A, ports 88 are disposed above upper seals 78. This corresponds to a closed position of valve means 85.

Below ported mandrel 50, a plurality of generally slotted transverse openings 90 are defined through valve sleeve 84. It will be seen that transverse openings 90 provide communication between annulus 86 and central opening 92 defined in tester valve 10.

Figure 2B:
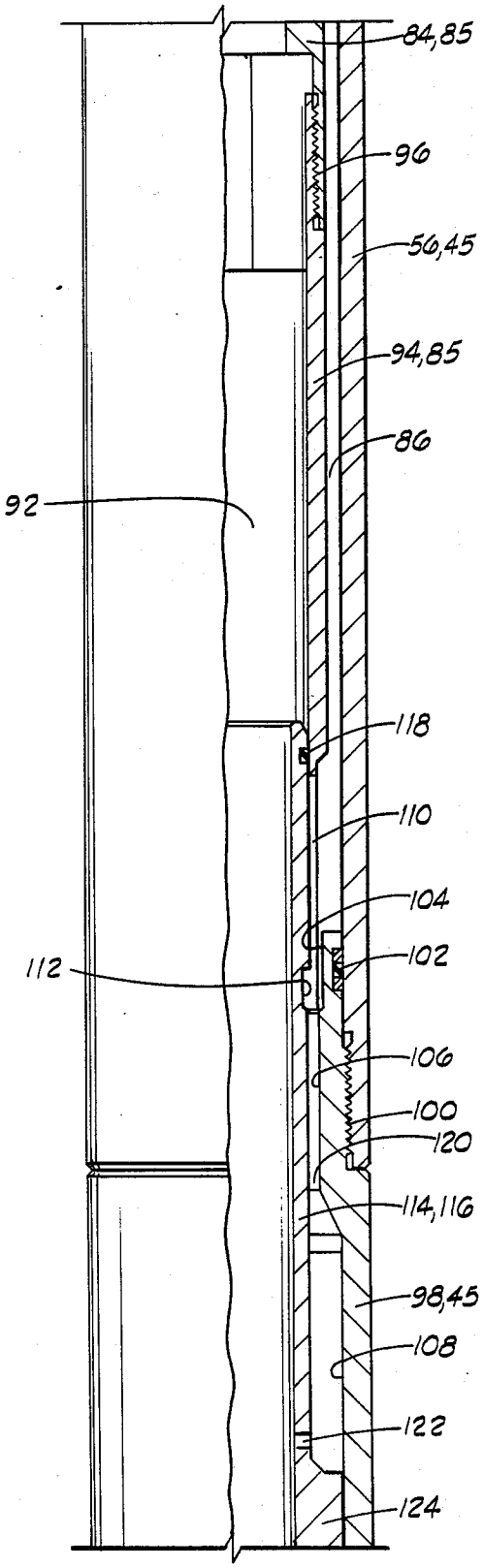

Referring now to FIG. 2B, the lower end of valve sleeve 84 is attached to valve connector or collet 94 at threaded connection 96. Valve connector 94 forms a lower end of valve means 85 in the embodiment shown.

The lower end of valve case 56 is connected to a circulating case 98, which thus forms another portion of housing means 45, at threaded connection 100. A sealing means 102 provides a sealing means between valve case 56 and circulating case 98.

Circulating case 98 has a first bore 104 and a somewhat smaller second bore 106 therebelow. A third bore 108 is defined below second bore 106.

Valve connector 94 has a plurality of downwardly extending collet fingers 110 thereon which are adapted for engagement with an annular collet groove or recess 112 in the upper portion of a circulating mandrel 114. In the embodiment shown, circulating mandrel 114 is the upper component of a bypass means or bypass valve means 116. A sealing means, such as wiper ring 118, is provided between circulating mandrel 114 and valve connector 94.

An annulus 120 is defined between and upper portion of circulating mandrel 114 and circulating case 98. It will be seen by those skilled in the art that, because of longitudinal gaps between collet fingers 110, annulus 120 is in communication with annulus 86. A substantially transverse port 122 is defined through circulating mandrel 114 thus providing communication between annulus 120 and central opening 92.

Figure 2C:
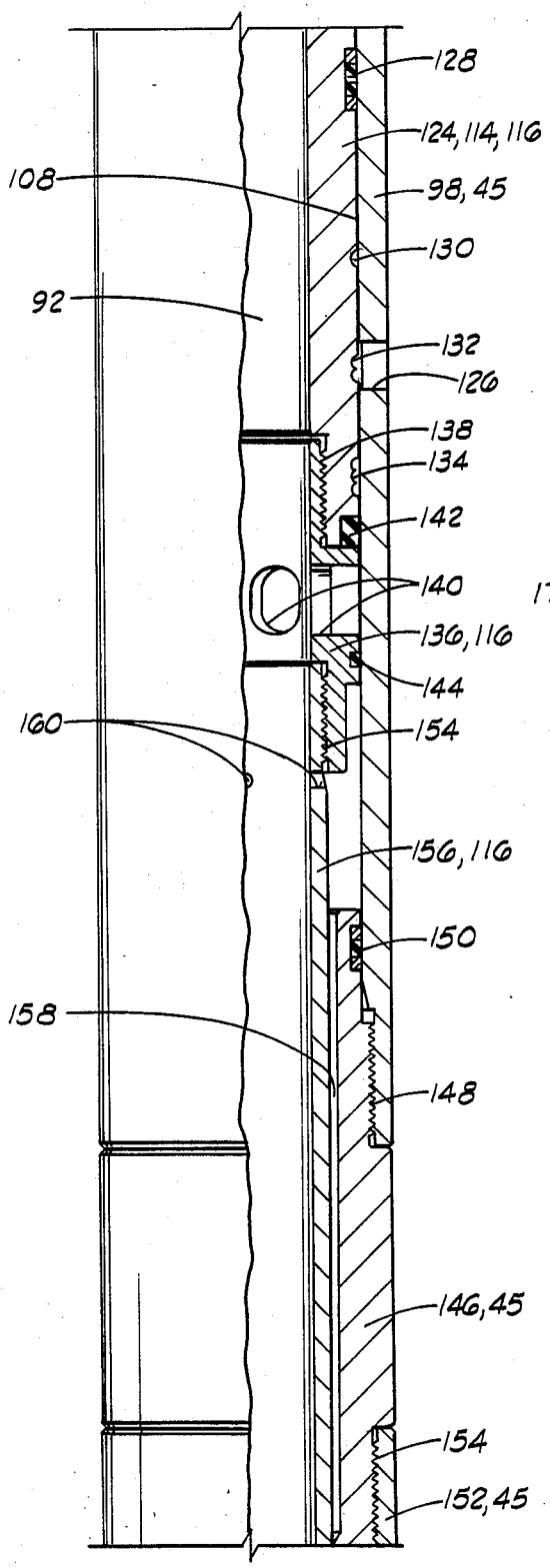

Referring now also to FIG. 2C, circulating mandrel 114 has an enlarged lower portion 124 which is in close spaced relationship to third bore 108 in circulating case 98.

Circulating case 98 has a substantially transverse case bypass port 126 therein, also referred to as a housing port 126, and a sealing means 128 is provided between circulating mandrel 114 and circulating case 98 at a longitudinal position above case bypass port 126.

The radially outer surface of lower portion 124 of circulating mandrel 114 has a single indicator groove 130, a double indicator groove 132 and a triple indicator groove 134 therein which are visible through case bypass port 126 depending upon the position of circulating mandrel 114 with respect to circulating case 98. These grooves are used to check the position of circulating mandrel 114 during make-up of tester valve 10 and the testing thereof at the surface before it is installed in tool string 112. In the various positions, the grooves are aligned with, and visible through, housing port 126, as is illustrated for double indicator groove 132 in FIG. 2C.

Lower portion 124 of circulating mandrel 114 is connected to a circulating valve sleeve 136 at threaded connection 138. Circulating valve sleeve 136 defines a plurality of substantially transverse circulating valve ports 140 therein which are in communication with central opening 92. Sealing means, such as seal ring 142 of above ports 140 and O-ring 144 below ports 140 sealingly engage third bore 108 in circulating case 98. Thus, it will be seen by those skilled in the art that, in the configuration shown in FIG. 2C, circulating valve ports 140 are sealingly isolated from case bypass ports 126. This corresponds to one closed position of bypass means 116.

The lower end of circulating case 98 is attached to sealing nipple 146 at threaded connection 148. Sealing means 150 provides sealing engagement between circulating case 98 and sealing nipple 146.

The lower end of sealing nipple 146 is connected to oil case 152 at threaded connection 154. Both sealing nipple 146 and oil case 152 will be seen to form part of housing means 45.

Connected to the lower end of circulating valve sleeve 136 at threaded connection 154 is an operating mandrel 156. Operating mandrel 156 thus forms a portion of bypass valve means 116.

It will be seen that an annulus 158 is defined between operating mandrel 156 and a portion of housing means 45. A plurality of operating mandrel ports 160 are defined through operating mandrel 156, thus providing communication between annulus 158 and central opening 92.

Figure 2D:
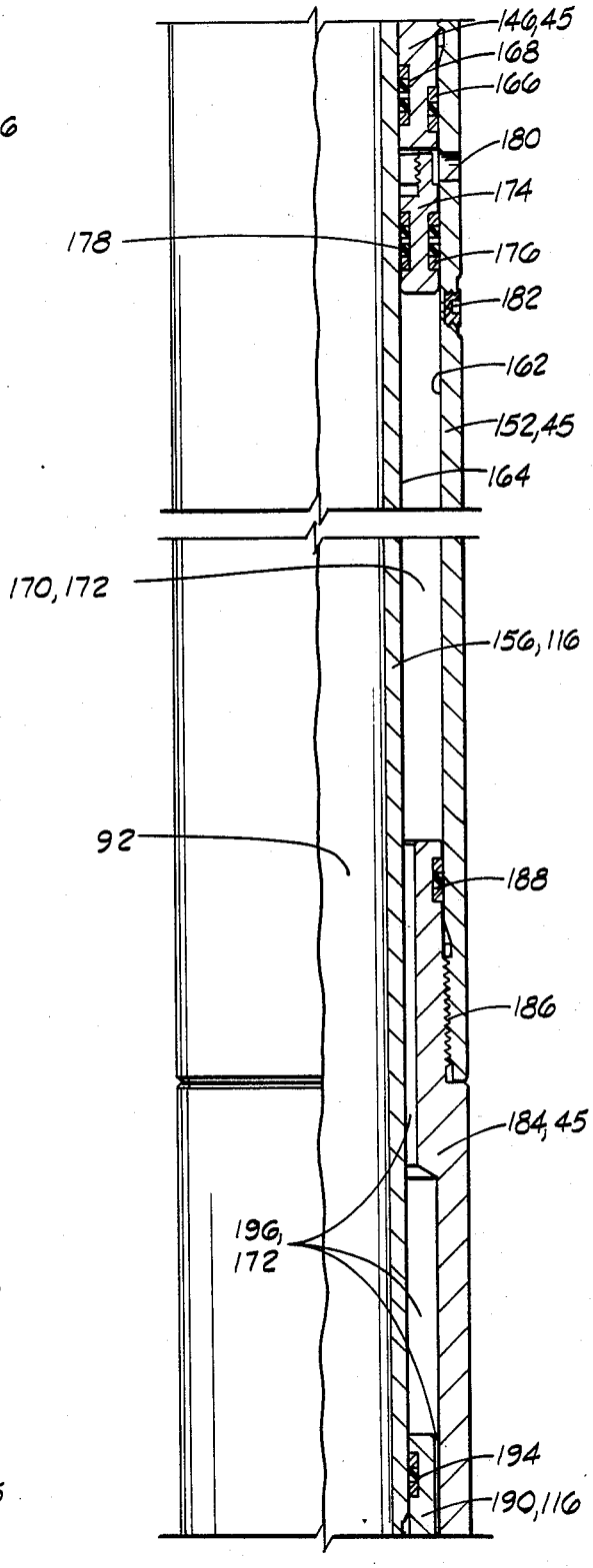

Referring now to FIG. 2D, sealing nipple 146 has an enlarged lower end which is in close spaced relationship to bore 162 in oil case 152 and outside diameter 164 of operating mandrel 156. An outer sealing means 166 provides sealing engagement between sealing nipple 146 and bore 162 of oil case 152, and an inner sealing means provides sealing communication between sealing nipple 146 and outside diameter 164 of operating mandrel 156. It will be seen that an annular volume 170 is defined between outside diameter 164 of operating mandrel 156 and bore 162 of oil case 152. As will be discussed in more detail herein, annular volume 170 is filled with oil and thus forms an upper portion of an oil chamber 172.

Slidably disposed in annular volume 170 is an upper floating piston 174. Outer and inner piston sealing means 176 and 178, respectively, provide sealing engagement between floating piston 174 and bore 162 of oil case 152 and outside diameter 164 of operating mandrel 156.

A substantially transverse oil case port 180 is defined in oil case 152 at a position adjacent to the upper end of upper floating piston 174 and above outer and inner piston sealing means 176 and 178. Thus, well annulus pressure is in communication with the upper side of upper floating piston 174. An oil filler port 182 is provided in oil case 152 in communication with annular volume 170 so that oil chamber 172 may be filled. Oil filler port 182 may be closed by a pipe plug or other similar means.

The lower end of oil case 152 is connected to an operating case 184 at threaded connection 186. A sealing means 188 provides a seal between oil case 152 and operating case 184.

Figure 2E:
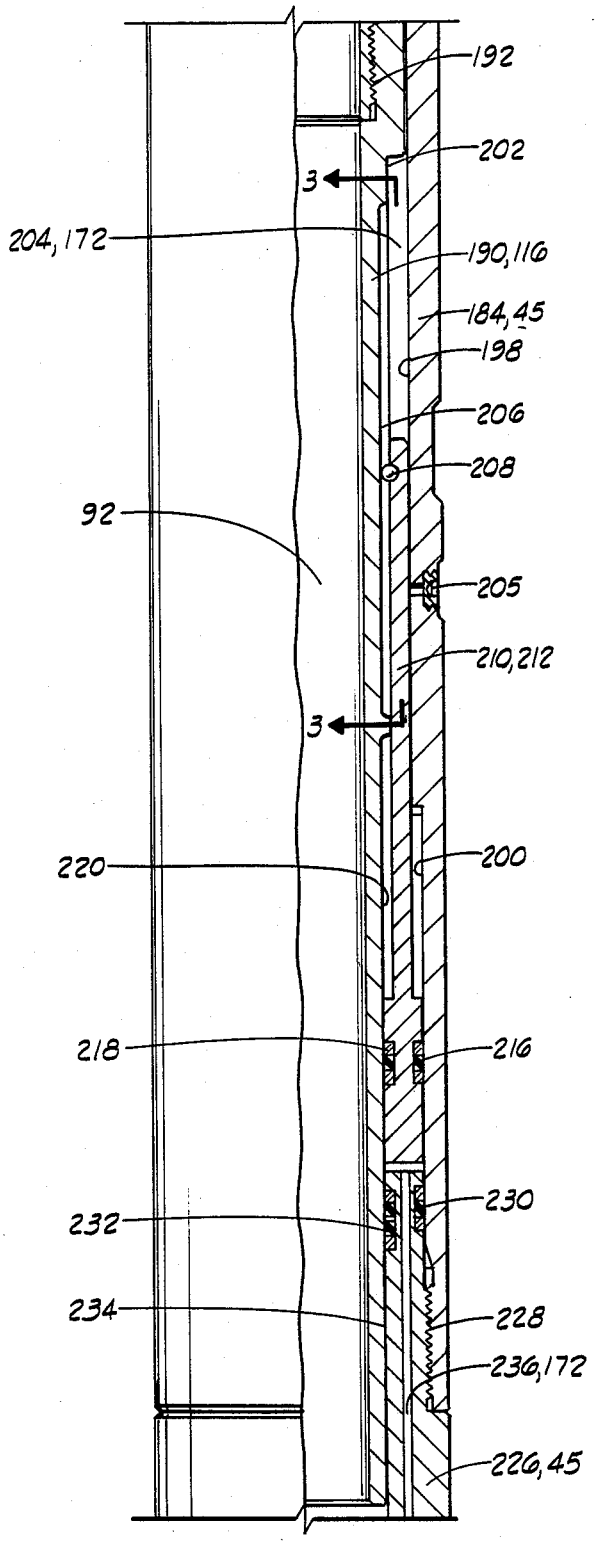

Referring now to FIGS. 2D and 2E, the lower end of operating mandrel 156 is connected to ratchet 190 at threaded connection 192 with sealing engagement therebetween provided by sealing means 194. Ratchet 190 thus forms a portion of bypass valve means 116. As best seen in FIG. 2D, a variably sized annular volume 196 is defined between the inner surfaces of operating case 140 and the outer surfaces of operating mandrel 156 and ratchet 190. This annulus 196 is in communication with annular volume 170 and thus also forms a portion of oil chamber 172.

As shown in FIG. 2E, operating case 184 has a first bore 198 with a somewhat larger second bore 200 therebelow. Ratchet 190 has an outside diameter 202 spaced inwardly from first bore 198 in operating case 184 such that an annular volume 204 is defined therebetween. It will be seen that annular volume 204 is another portion of oil chamber 172. An operating case port 205 is provided for filling oil chamber 172.

Figure 3:
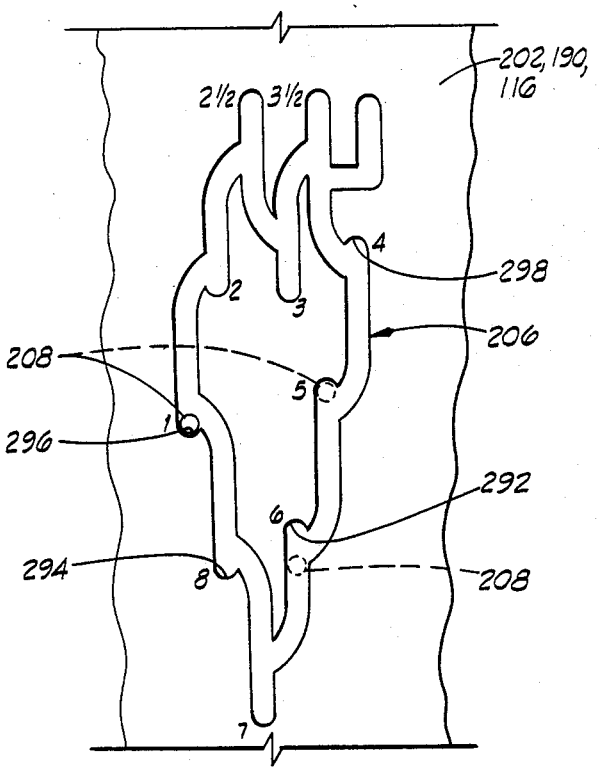
FIG. 3 is a view taken along lines 3—3 in FIG. 2E showing the pattern of a ratchet used in the tester valve.

Referring also to FIG. 3, outside diameter 202 of ratchet 190 defines a recessed "J-slot" ratchet pattern 206 therein. Engaging J-slot 206 is a ball bearing 208 carried by an operating valve 210 of an operating valve assembly or means 212. As will be discussed in more detail herein, the relative position of ball bearing 208 and J-slot 206 determines the positions of bypass valve means 116 and valve means 85.

An outer sealing means 216 provides sealing engagement between a lower portion of operating valve assembly 212 and second bore 200 of operating case 184, and an inner sealing means 218 provides sealing engagement between the lower portion of operating valve assembly 212 and a second outside diameter 220 of ratchet 190.

The lower end of operating case 184 is attached to power nipple 226, another component of housing means 45, at threaded connection 228. An outer sealing means provides sealing engagement between power nipple 226 and operating case 184, and an inner sealing means 232 provides sealing engagement between first bore 234 of power nipple 226 and second outside diameter 220 of ratchet 190.

Figure 2F:
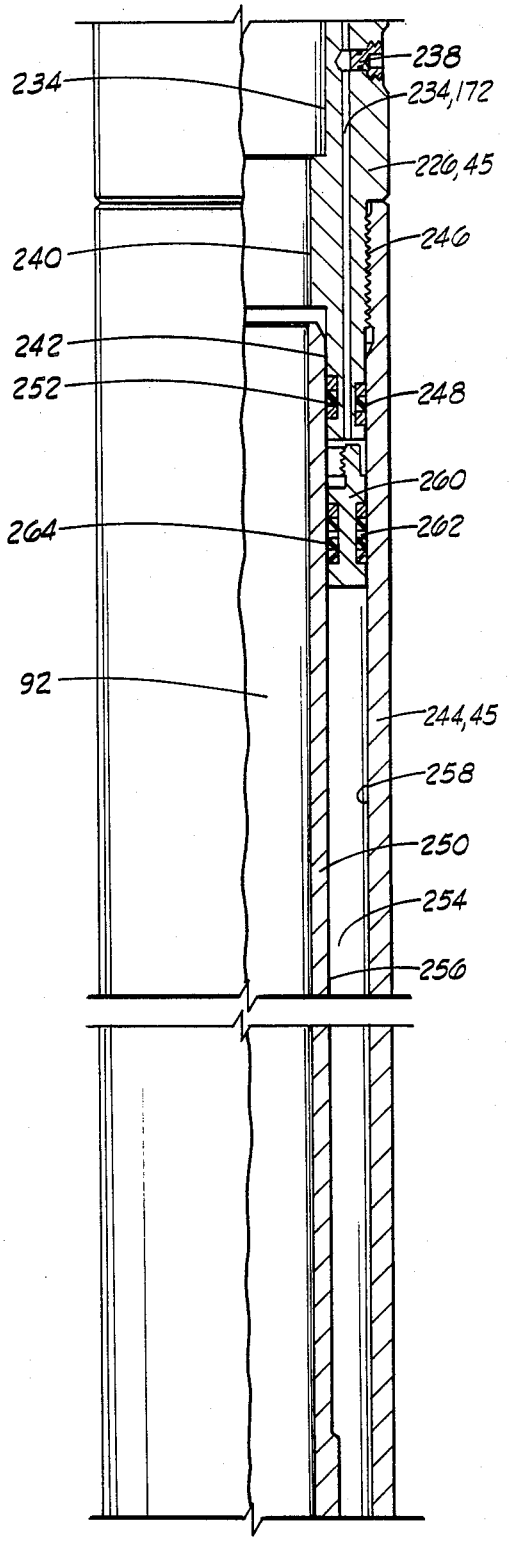
Figure 2:
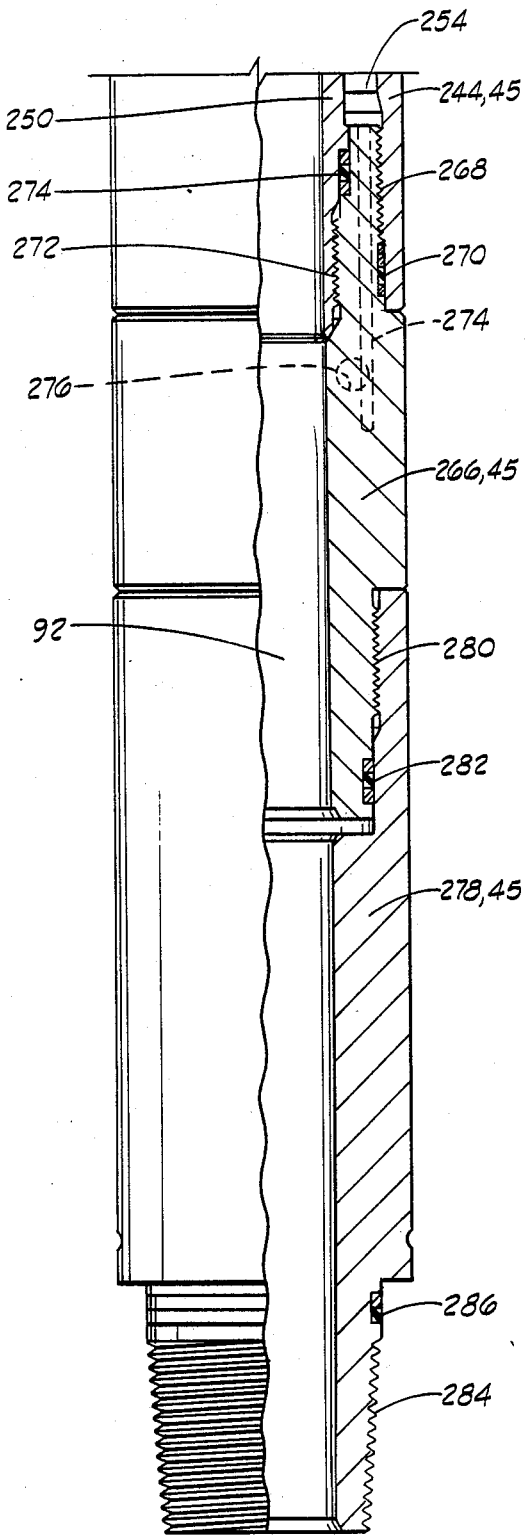

Referring also to FIG. 2F, power nipple 226 defines a substantially longitudinal passageway or bore 236 therethrough, and it will be seen by those skilled in the art that longitudinal passageway 236 forms still another portion of oil chamber 172. A substantially transverse power nipple port 238 is defined in power nipple 226 to facilitate filling of oil chamber 172 with oil.

Below first bore 234 in power nipple 226 are a second bore 240 and a third bore 242 which is slightly larger than second bore 240. The lower end of power nipple 226 is connected to gas case 244 at threaded connection 246. Gas case 244 is another component of housing means 45, and an outer sealing means 248 provides sealing engagement between power nipple 226 and gas case 244.

The upper end of a gas mandrel 250 is disposed in third bore 242 of power nipple 226. An inner sealing means 252 provides sealing engagement between power nipple 226 and gas mandrel 250.

Gas mandrel 250 extends downwardly through gas case 240 such that an annular volume 254, or gas chamber 254, is defined between outside diameter 256 on gas mandrel 250 and bore 258 in gas case 244. A lower floating piston 260 is slidably disposed in gas chamber 254. An outer sealing means 262 provides sealing engagement between lower floating piston 260 and bore 258 of gas case 244, and an inner sealing means 264 provides sealing engagement between floating piston 260 and outside diameter 256 of gas mandrel 250. Annular volume 254 is preferably filled with a compressible, substantially inert gas such as nitrogen. It will thus be seen by those skilled in the art that the lower end of lower floating piston 260 is in contact with the gas, and the upper end of floating piston 260 is in contact with oil in oil chamber 172.

Referring now to FIG. 2G, the lower end of gas case 244 is attached to filler valve body 266, another component of housing means 45, at threaded connection 268. Sealing means 270 provides sealing engagement between gas case 244 and filler valve body 266. The lower end of gas mandrel 250 is also connected to filler valve body 266 at inner threaded connection 272, and another sealing means 274 provides sealing engagement between gas mandrel 250 and filler valve body 266.

Filler valve body 266 defines a substantially longitudinally extending hole 274 therein which is in communication with gas chamber 254. Filler valve body 266 also defines a port 276 extending substantially transversely with respect to hole 274 and in communication therewith. A filler valve (not shown) of a kind known in the art may be positioned in port 276 to allow filling of hole 274 and annular volume 254 with the desired gas.

The lower end of filler valve body 266 is attached to lower adapter 278 at threaded connection 280. Lower adapter 278 is the lowermost component of housing means 45 in the embodiment shown in the drawings, and a sealing means 282 provides sealing engagement between filler valve body 266 and lower adapter 278. The lower end of lower adapter 278 has an external thread 284 and a sealing means 286 adapted for engagement with a lower portion of tool string 12.

Operation Of The Invention

Tool string 12 is lowered into well bore 14 to a position at which perforating guns 34 are approximately aligned with formation 42 to be tested. Packer 28 is placed into sealing engagement with well bore 14 by inflation or other means in a manner known in the art so that an upper well annulus portion 288 is defined above packer 28, and a lower well annulus portion 290 is defined below packer 28.

When tool string 12 is positioned in well bore 14 and packer 28 inflated, the configuration of tester valve 10 is such that valve means 85 is in the closed position shown in FIGS. 2A–2G. Also, bypass valve means 116 is generally in the closed position shown in FIGS. 2A–2G, although tester valve 10 could be run into well bore 14 with bypass valve means 116 in the open position.

Figure 4:
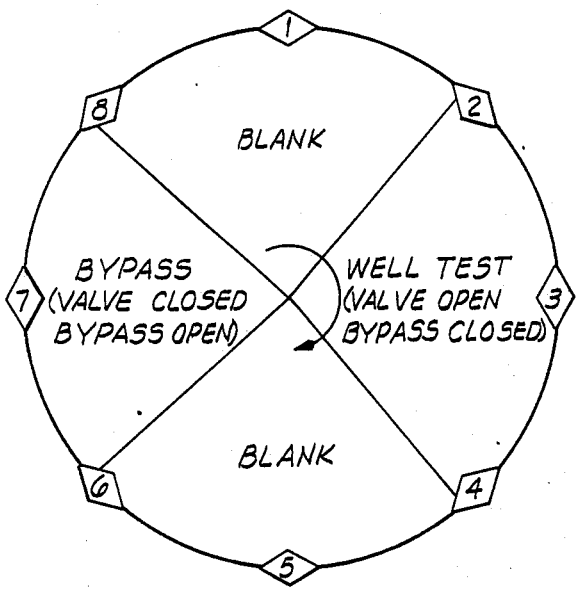
FIG. 4 illustrates a cycle chart showing the various positions of the tester valve and a sequence of operation.

Referring now to FIGS. 3 and 4, with both valve means 85 and bypass valve means 116 closed, tester valve 10 is said to be in a "blank" position as indicated by numeral 5. FIG. 4 is a schematic showing the various positions of tester valve 10, and the numerals in FIG. 4 correspond to the positions on J-slot 206 shown in FIG. 3. FIG. 4 has no significance as to rotation of the tool, however.

By applying pressure, as by a surface pump, to upper well annulus 288 above packer 28, pressure is thus applied above upper floating piston 174 through oil case port 180. The well annulus pressure thus forces floating piston 174 downwardly, and because the oil filling oil chamber 172 is substantially incompressible, it will be seen that operating valve assembly 212 is thus forced downwardly. This in turn causes lower floating piston 260 to be moved downwardly, thereby compressing the gas in gas chamber 254.

As operating valve assembly 212 is moved downwardly toward its lowermost position as sown in FIG. 2E, ball bearing 208 moves downwardly through J-slot 206 until ball bearing 208 is at a position approximately midway between positions 6 and 7 on the J-slot. Pressure in well annulus 288 is then relieved, and the gas pressure in gas chamber 254 acts upwardly on lower floating piston 260 which in turn forces upwardly upper floating piston 174 and operating valve assembly 212. During this movement, ball bearing 208 engages surface 292 at position 6 in J-slot 206 and forces bypass valve means 116 upwardly until it is in a bypass or open position in which ports 140 in circulating valve sleeve 136 are substantially aligned with case bypass port 126 in circulating case 98 of housing means 45.

It will be seen by those skilled in the art that as bypass means 116 is moved to this bypass position, collet fingers 110 on valve sleeve 84 will be forced outwardly in first bore 104 of circulating case 98 as circulating mandrel 114 of bypass valve means 116 moves upwardly, so that the collet fingers are disengaged from collet recess 112. In other words, when bypass valve means 116 is in the open position, collet recess 112 is above the lower end of collet fingers 110. It will be seen that at all times the pressure acting on the bypass valve means above and below ports 140 is equalized by means of ports 122 and 160.

When bypass valve means 116 is in the open position, well annulus 288 is again repressurized. When this occurs, operating valve assembly 212 is again actuated downwardly in the same manner as previously described. In this instance, ball bearing 208 moves downwardly from position 6 in J-slot 206 to position 7. Operating valve assembly 212 reaches its lowermost point without engaging the J-slot at position 7 so that no movement of bypass valve means 116 occurs during this pressurization.

When bypass valve means 116 is in the open position, and annulus 288 pressurized, it will be seen that well annulus pressure is thus communicated to central opening 92 of testing tool 10. Central opening 92 is in communication with lower portions of testing string 12, and this pressurization is used to actuate firing means 36. As previously indicated, firing means 36 is preferably a time delayed firing means. That is, once actuated by the well annulus pressure, the firing means will not trigger perforating guns 34 for a preset period of time, such as five to ten minutes.

During this time delay, the operator at the surface relieves the pressure in well annulus 288, thus allowing operating valve assembly 212 to again be forced upwardly by the biasing means provided by the gas in gas chamber 254, at which point ball bearing 2 O B will be located in J-slot 206 corresponding to position 8 thereof. At this point, well annulus 288 is again pressurized. Actuating valve 212 is forced downwardly such that ball bearing 208 engages surface 294 at position 8 in J-slot 206, thus forcing bypass valve means 116 downwardly so that it is again in a closed position. At this point, triple indicator groove 134 on circulating mandrel 114 is approximately aligned with case bypass port 126. Pressure in well annulus 288 may then again be raised and relieved which actuates actuating valve assembly 212, moving bypass valve means 116 downwardly to the position shown in FIGS. 2A–2G in which double indicator groove 132 is aligned with case bypass port 126. At this point, the lugs on the lower end of collet fingers 110 engage collet recess 112 on circulating mandrel 114. This cycling does not really functionally change the positions of bypass means 116 or valve means 85, but does allow pressurization of the well annulus to carry out other functions on other tool string components if needed.

The closing of bypass valve means 116 is carried out prior to the firing of perforating guns 34. Once guns 34 fire, well casing 44 is perforated so that fluid from well formation 42 flows into lower well annulus 290. The fluid in well annulus 290 flows into tool string 12 through check valve 32 in a manner known in the art and is thus in communication with central opening 92 in tester valve 10. Debris from the perforating operating either falls to the bottom of well bore 14 or once entering testing string 12 through check valve 32 will fall downwardly into blank guns 38. Also, the size of blank guns 38 determines the first flow period after fluid first enters back check valve 32. The instrumentation in gauge carrier 40 measures the change in pressure and temperature versus time, which is read out at the surface in a manner known in the art.

Before or after perforating guns 34 fire, the pressure in well annulus 288 is again relieved so that actuating valve assembly 212 moves upwardly in J-slot 206 so that ball bearing 2 08 is approximately aligned at position 2 in the J-slot. It will be seen, of course, that tester valve 10 is still in a blank position with both valve means 85 and bypass valve means 116 closed.

To flow a sample of fluid into sample chamber 20 above tester valve 10, pressure in well annulus 288 is again increased which forces operating valve assembly 212 downwardly. The engagement of ball bearing 208 against surface 296 forces bypass means 116 downwardly from the closed position shown in FIGS. 2A–2G, but bypass means 116 remains closed. At this point, single indicator groove 130 is approximately aligned with case bypass port 126.

Because of the engagement of collet fingers 110 with collet recess 112, it will be seen that this further downward movement of bypass valve means 116 pulls valve means 85 downwardly as well. When actuating valve assembly 212 reaches its lowermost position, valve means 85 will be in an open position wherein port 288 in valve sleeve 204 will be substantially aligned with ports 72 in cylindrical portion 68 of ported mandrel 50. Thus, central opening 92 in tester valve 10 will be placed in communication with central cavity 74 above ports 72. A sample of fluid may then flow upwardly from well annulus 290 through check valve 32, through tester valve 10 and into sample chamber 20. Gauge carrier 22 is then used to measure the changes in pressure and temperature versus time as sample chamber 20 is filled.

When pressure is relieved in well annulus 288, ball bearing 208 on operating valve assembly 212 will be moved to approximately position 2½ in J-slot 206. The well annulus can be again pressurized so that operating valve assembly moves downwardly where ball bearing 208 is at position 3 in J-slot 206. When this pressure is relieved, ball bearing 208 will be moved to approximately position 3½ in J-slot 206. As will be seen by those skilled in the art, this has no effect on the position of bypass valve means 116 or valve means 85. This allows the use of well annulus pressure to be used to actuate other devices in testing string 12, if any, without closing valve means 85.

However, if well annulus 288 is pressurized once again, it will be seen that ball bearing 208 moves downwardly to approximately position 4 in J-slot 206, and when the pressure is relieved, the ball bearing on operating valve assembly 212 engages surface 298 at position 4, thus forcing bypass valve means 116 upwardly and valve means 85 upwardly with the bypass valve means such that tester valve 10 is again in the blank position shown in FIGS. 2A–2G. At this point, it will be seen by those skilled in the art that the cycling system can be restarted as desired.

It will be seen, therefore, that the above packer perforate, test and sample tool of the present invention is well adapted to carry out the ends and advantages mentioned as well as those inherent therein. While a presently preferred embodiment of the apparatus has been shown for the purposes of this disclosure, numerous changes in the arrangement and construction of parts may be made by those skilled in the art. All such changes are encompassed within the scope and spirit of the appended claims.

What is claimed is:

1. A valve for use above a packer in a well testing string, said valve comprising:

housing means for connecting to said testing string, said housing means defining a substantially longitudinally extending central opening therethrough;

bypass means on said housing means for providing communication between said central opening and a well annulus portion above said packer, whereby annulus pressure may be communicated to a testing string portion below said packer, said bypass means having selectable open and closed positions; and sliding valve means disposed above said bypass means in said housing means for providing communication between said central opening and a portion of said testing string above said housing means, said valve means having selectable open and closed positions.

2. The valve of claim 1 further comprising actuating means for selectively opening and closing said bypass means and said valve means.

3. The valve of claim 2 wherein said actuating means comprises:

a ratchet on said bypass means; and an operating piston engaging said ratchet for actuating said bypass valve in response to well annulus pressure.

4. The valve of claim 2 further comprising biasing means for biasing said actuating means upwardly within said housing means.

5. The valve of claim 4 wherein said biasing means comprises a gas filled chamber providing an upwardly acting pressure on said actuating means.

6. The valve of claim 1 wherein said bypass means comprises:

said housing means defining a housing port therein opening into said well annulus portion above said packer; and a slidable bypass valve having a substantially transverse bypass valve port therein, said bypass valve port being substantially aligned with said housing port when said bypass means is in said open position.

7. The valve of claim 1 wherein said sliding valve means comprises:

a mandrel disposed in said housing means and defining a mandrel port therein in communication with said portion of said testing string above said housing means; and a valve sleeve slidably disposed on said mandrel and defining a valve port therein, said valve port being substantially aligned with said mandrel port when said valve means is in said open position.

8. The valve of claim 7 wherein said bypass means comprises:

said housing means defining a housing port therein; and a bypass valve slidably disposed in said housing means and defining a bypass valve port therein, said bypass valve port being substantially aligned with said housing port when said bypass means is in said open position.

9. The valve of claim 8 further comprising:

a ratchet on said sliding bypass valve; and an operating piston assembly engaging said ratchet for longitudinally sliding said bypass valve in response to well annulus pressure.

10. The valve of claim 8 further comprising collet means for releasably connecting said valve sleeve with said bypass valve.

11. The valve of claim 1 further comprising indicator means for indicating a position of said bypass means with respect to said housing means.

12. A downhole tool for using a well bore and comprising:

guns for perforating a well formation in said well bore;

firing means for firing said guns;

a packer disposed above said guns and firing means for isolating said formation from an upper well annulus portion above said packer;

a sampling chamber disposed above said packer; and a tester valve disposed above said packer and in communication with said sampling chamber, said tester valve comprising:

bypass means for selectively providing communication of fluid pressure in said upper well annulus to said firing means after setting of said packer; and valve means for selectively providing communication between said well formation and said sampling chamber so that said sampling chamber may be filled with a sample of fluid.

13. The tool of claim 12 further comprising actuating means for selectively actuating said bypass means and said valve means in response to a pressure in said upper well annulus.

14. The tool of claim 13 wherein said actuating means comprises an operating valve engaging a ratchet pattern on said biasing means for guiding said biasing means when upper well annulus pressure is applied to said actuating means.

15. The tool of claim 14 further comprising means for upwardly biasing said actuating means when said pressure in said upper well annulus is relieved.

16. The tool of claim 14 further comprising means for releasably connecting said valve means to said bypass means.

17. A method of testing a well formation in a well bore, said method comprising the steps of:

positioning guns on a tool string in said well bore adjacent to said formation;

actuating a packer on said tool string for sealingly engaging said well bore above said formation such that an upper well annulus portion is defined between said well bore and said tool string above said packer;

providing pressure in said upper annulus portion, through a bypass in a tester tool above said packer, to a firing device adjacent to said guns for firing said guns and perforating said formation; and flowing a sample of fluid from said formation through said tester valve to a sampling chamber positioned above said packer.

18. The method of claim 17 wherein said step of providing pressure comprises opening a bypass valve in said tester valve above said packer in response to a pressure in said upper well annulus portion.

19. The method of claim 17 further comprising closing said bypass valve prior to said step of flowing a sample.

20. The method of claim 17 wherein said step of flowing a sample comprises opening a sampling valve in said tester valve in response to a pressure in said upper well annulus portion.

* * * * *

UNITED STATES PATENT AND TRADEMARK OFFICE

CERTIFICATE OF CORRECTION

PATENT NO. : 4,915,171

DATED : April 10, 1990

INVENTOR(S) : Michael E. McMahan

It is certified that error appears in the above-identified patent and that said Letters Patent is hereby corrected as shown below:

In column 3, line 29, delete the letter [s] and insert therefore --so--.

In column 4, line 67, delete the letter [o] and insert therefore --on--.

In column 9, line 50, delete the numeral [20B] and insert therefore --208--.

Signed and Sealed this

Thirteenth Day of October, 1992

*Attest:*

DOUGLAS B. COMER

*Attesting Officer*

*Acting Commissioner of Patents and Trademarks*